US008870036B2

(12) United States Patent
Kulkarni et al.

(10) Patent No.: US 8,870,036 B2
(45) Date of Patent: Oct. 28, 2014

(54) DISPENSING APPARATUS FOR USE WITH PRESSURIZED CONTAINERS

(71) Applicant: Koolatron Corporation, Brantford (CA)

(72) Inventors: Arun Kulkarni, Brantford (CA); Leonardo Aldana, Waterloo (CA)

(73) Assignee: Koolatron Corporation, Brantford (CA)

( * ) Notice: Subject to any disclaimer, the term of this patent is extended or adjusted under 35 U.S.C. 154(b) by 14 days.

(21) Appl. No.: 13/749,138

(22) Filed: Jan. 24, 2013

(65) Prior Publication Data

US 2013/0186916 A1 Jul. 25, 2013

Related U.S. Application Data

(60) Provisional application No. 61/590,281, filed on Jan. 24, 2012.

(51) Int. Cl.

| | |
|---|---|
| ***B65D 83/00*** | (2006.01) |
| ***B67D 1/00*** | (2006.01) |
| *B67D 1/08* | (2006.01) |

(52) U.S. Cl.

CPC ..... *B67D 1/0082* (2013.01); *B67D 1/0869* (2013.01)

USPC ..... 222/394; 222/402.1; 222/402.13; 222/183

(58) Field of Classification Search

CPC ..... B67D 1/0082; B67D 1/0869

USPC ..... 222/394, 399, 395, 400.7, 131, 183, 222/402.1, 402.13, 402.15

See application file for complete search history.

(56) References Cited

U.S. PATENT DOCUMENTS

| | | | | |
|---|---|---|---|---|
| 2,176,947 | A * | 10/1939 | Anagno | 137/589 |
| 2,675,822 | A * | 4/1954 | Redlin | 137/170.3 |
| 3,143,254 | A * | 8/1964 | Vanderhyde | 222/402.11 |
| 3,354,668 | A * | 11/1967 | Cserny | 62/449 |
| 4,773,571 | A * | 9/1988 | Hagan et al. | 222/394 |
| 5,246,140 | A * | 9/1993 | Thix et al. | 222/4 |
| 6,454,131 | B1 * | 9/2002 | Van Der Meer et al. | 222/95 |
| 7,077,298 | B2 * | 7/2006 | Vlooswijk et al. | 222/402.13 |
| 8,079,496 | B2 * | 12/2011 | Pakkert et al. | 222/146.6 |
| 8,191,734 | B2 * | 6/2012 | Lupfer | 222/5 |
| 2003/0071067 | A1 * | 4/2003 | Sluijter | 222/183 |
| 2006/0081660 | A1 * | 4/2006 | Harvey et al. | 222/402.1 |
| 2007/0056990 | A1 * | 3/2007 | Pakkert et al. | 222/146.6 |
| 2007/0158371 | A1 * | 7/2007 | Lupfer | 222/402.13 |
| 2008/0128456 | A1 * | 6/2008 | Grimwade et al. | 222/399 |
| 2008/0197157 | A1 * | 8/2008 | Troost et al. | 222/530 |
| 2012/0248139 | A1 * | 10/2012 | Haskayne et al. | 222/1 |
| 2013/0313290 | A1 * | 11/2013 | Lassen | 222/399 |

* cited by examiner

*Primary Examiner* — Paul R. Durand
*Assistant Examiner* — Donnell Long
(74) *Attorney, Agent, or Firm* — Bereskin & Parr LLP/S.E.N.C.R.L., s.r.l.

(57) ABSTRACT

A dispensing apparatus for use with a pressurized container having a push valve. The dispensing apparatus includes an enclosure adapted to enclose at least a portion of the pressurized container. A pour actuator is movable between a released position and an actuated position, and controls a plunger. When the pour actuator is moved to the actuated position, the plunger depresses the push valve of the pressurized container to permit contents of the pressurized container to be dispensed out of the dispensing apparatus.

20 Claims, 10 Drawing Sheets

DISPENSING APPARATUS FOR USE WITH PRESSURIZED CONTAINERS

CROSS REFERENCE TO RELATED APPLICATION

This application claims priority to U.S. Provisional Application No. 61/590,281 filed on Jan. 24, 2012, the entire contents of which are hereby incorporated herein by reference.

TECHNICAL FIELD

The present disclosure relates to apparatuses for dispensing fluids from pressurized containers.

BACKGROUND

The following paragraphs are not an admission that anything discussed in them is prior art or part of the knowledge of persons skilled in the art.

Pressurized containers are part of everyday life and are used to dispense various fluids in a spray or a liquid state. Pressurized containers may include, for example but not limited to, beer kegs, paint spray cans, and insecticide spray cans, among others.

In particular, kegs are commonly used to store, transport, and serve beer, and may be constructed of aluminum or steel. Various other alcoholic or non-alcoholic, carbonated or non-carbonated drinks may be housed in a keg. Beverages in a keg are generally kept under pressure, and may be cooled.

Recently, 5-liter "mini kegs" have become widely available for retail purchase. Some brands of these mini kegs come with a spout and pour from the bottom via gravity, while others may use an inexpensive tap mechanism having a push valve.

INTRODUCTION

The following paragraphs are intended to introduce the reader to the more detailed description that follows and not to define or limit the claimed subject matter.

According to an aspect of the present disclosure, a dispensing apparatus is provided for use with a pressurized container having a push valve. The dispensing apparatus may include: an enclosure adapted to enclose at least a portion of the pressurized container; a pour actuator coupled to the enclosure, and movable between a released position and an actuated position; and a plunger controlled by the pour actuator, and arranged so that, when pour actuator is moved to the actuated position, the plunger depresses the push valve of the pressurized container to permit contents of the pressurized container to be dispensed out of the dispensing apparatus.

BRIEF DESCRIPTION OF THE DRAWINGS

The drawings included herewith are for illustrating various examples of apparatuses and methods of the present disclosure and are not intended to limit the scope of what is taught in any way. In the drawings.

DETAILED DESCRIPTION

Figure 1:
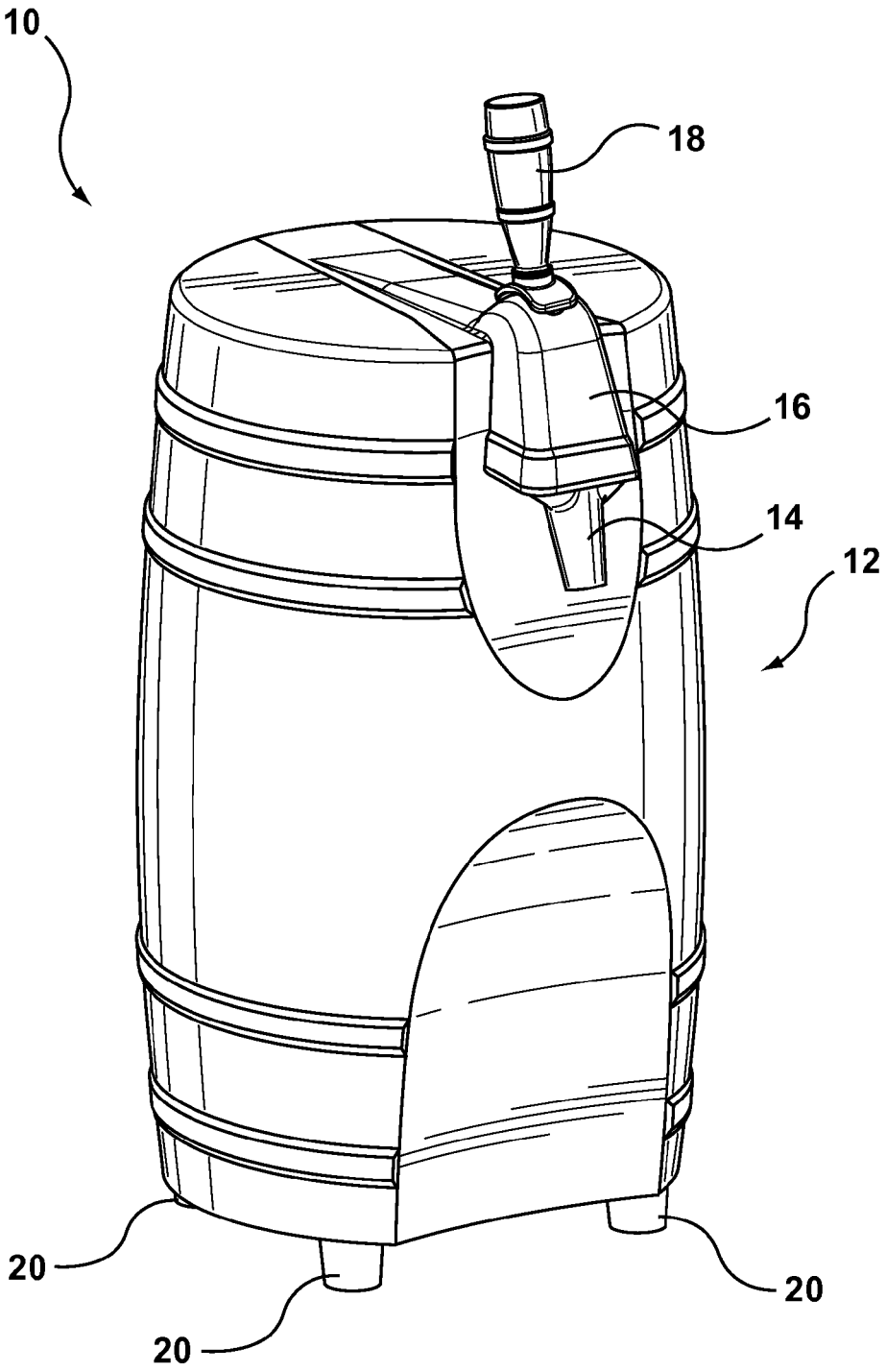
FIG. 1 is a perspective view of a dispensing apparatus according to an example.

Various apparatuses and/or methods are described below to provide an example of an embodiment of each claimed invention. No example described below limits any claimed invention and any claimed invention may cover apparatuses and methods that differ from those described below. The claimed inventions are not limited to apparatuses and methods having all of the features of any one apparatus or method described below or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, and the applicant(s), inventor(s) and/or owner(s) do not intend to abandon, disclaim or dedicate to the public any such invention by its disclosure in this document.

For simplicity and clarity of illustration, where considered appropriate, reference numerals may be repeated in the drawing to indicate corresponding or analogous elements or steps.

Generally, the concepts described herein are directed to a dispensing apparatus which includes an enclosure that is adapted to enclose at least a portion of a pressurized container. A pour actuator is positioned on the outside of the enclosure. Using the pour actuator, a push valve of the pressurized container, which may be positioned inside of the enclosure, is depressed by a plunger, permitting contents of the pressurized container to be dispensed out of the dispensing apparatus.

Referring to FIG. 1, an example of a dispensing apparatus is shown generally at 10. The dispensing apparatus 10 includes an enclosure 12, a spout 14, a top cap 16 and a pour actuator 18. Feet 20 are provided along a bottom surface of the enclosure 12 to raise the dispensing apparatus 10 off of a ground surface.

In the example illustrated, the pour actuator 18 is a user interface component, and takes the form of a handle, which may move forwards and backwards between released and actuated positions during a pouring operation. In other examples, the pour actuator 18 may take the form of a push button, which may move downwards and upwards during a pouring operation. Other user interface components are possible.

Figure 2:
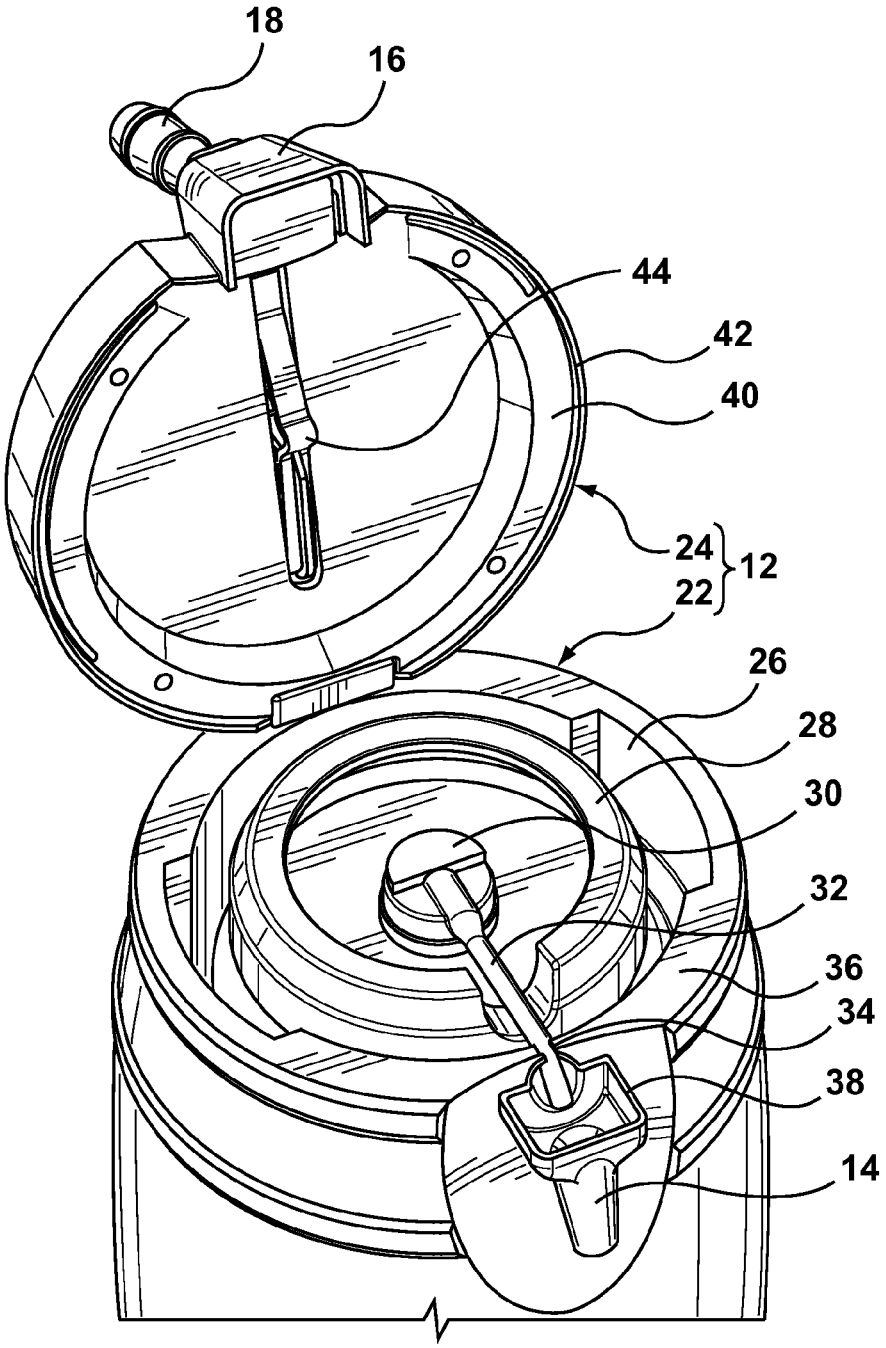
FIG. 2 is an enlarged perspective view of the dispensing apparatus of FIG. 1, and in which a lid assembly has been opened.

Referring to FIG. 2, the enclosure 12 is shown to consist of a generally cylindrical body 22, and a lid assembly 24 that is pivotally connected to the body 22. An inner cavity 26 of the body 22 is sized and shaped to receive a pressurized container 28.

The dispensing apparatus 10 may be an "aftermarket" product that is used in combination with the pressurized container 28, which may be available to consumers through retail purchase. In the example illustrated, the pressurized container 28 is generally cylindrical, and may take the form of, for example but not limited to, a 5-liter beer keg. It should be appreciated that various other shapes, sizes and configurations of the pressurized container are possible.

In various examples, the enclosure 12 encloses the entirety of the pressurized container 28, or at least a portion thereof (e.g., an upper half of the pressurized container 28). Enclosing the pressurized container 28 may be desirable to conceal the pressurized container 28 from view, and may present a more aesthetic and cosmetically appealing look. For example, the spout 14, which is optional, and in some cases may be omitted, may be included to improve the overall look of the enclosure 12 by giving it more of an authentic bar tap appearance.

Similarly the dispensing apparatus 10 may also be used for the purpose of hiding the labeling and brand trademarks on the pressurized container 28. Furthermore, the dispensing apparatus 10 may be configured to contain a potential leak from the pressurized container 28. Moreover, the enclosure 12 may be used to control the temperature of the pressurized container. For example, and not intended to be limiting, the body 22 may include a thermoelectric cooling system (not shown) configured to maintain contents of the pressurized container 28 at a desired temperature, e.g., 5 degrees Celsius.

In the example illustrated, the pressurized container 28 includes a push valve 30, which is illustrated to be disposed on a top wall of the pressurized container 28. The pressurized container 28 also includes a flow channel 32, which is shown to extend generally outwardly from adjacent to the push valve 30, along the top wall of the pressurized container 28, to a perimeter thereof. The flow channel 32 is arranged to direct fluid to flow into a reservoir 38, which feeds the spout 14. Both the spout 14 and the reservoir 38 are mounted to the body 22, and may be held in place with a clip 34 disposed along a top edge 36 of the body 22.

In other examples, the pressurized container may not have a flow channel that runs externally out of the pressurized container, but instead a port that is generally flush with an outer surface of the pressurized container. In such examples, the dispensing apparatus 10 may further include a tube for directing fluid to flow from the port of the pressurized container to the reservoir 38.

With continued reference to FIG. 2, the lid assembly 24 is shown to include a lid liner 40, and a lid case 42, which are complementary and fastened together, e.g., with fasteners, adhesive, and/or a snap fit arrangement. A plunger 44 protrudes downwardly from the lid liner 40. With the pressurized container 28 received in the inner cavity 26, the lid assembly 24 may be closed (as shown in FIG. 1), and locked in place using a suitable mechanical or magnetic mechanism (not shown). Once closed, the plunger 44 is positioned to depress the push valve 30. As is described in further detail below, the pour actuator 18 is coupled to the plunger 44 by one or more mechanical devices, and controls movement of the plunger 44 to depress the push valve 30 so that contents of the pressurized container 28 may be dispensed through the spout 14.

Figure 3:
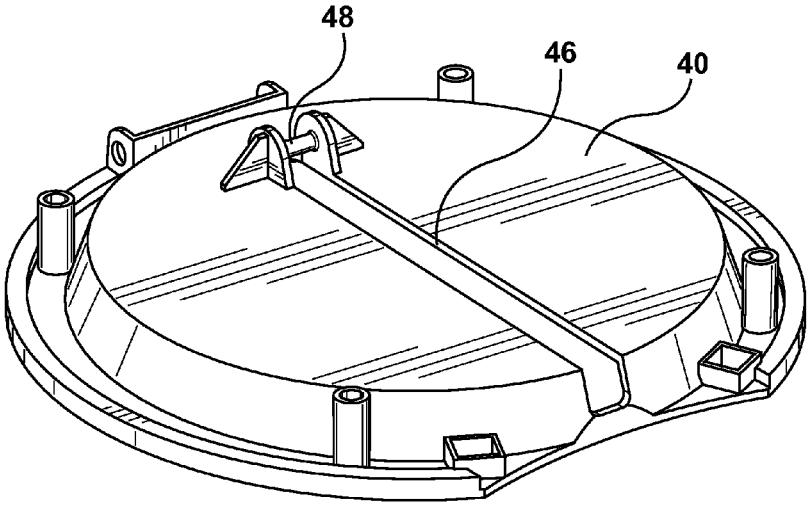
FIG. 3 is an upper perspective view of a lid liner of the dispensing apparatus of FIG. 1.
Figure 4:
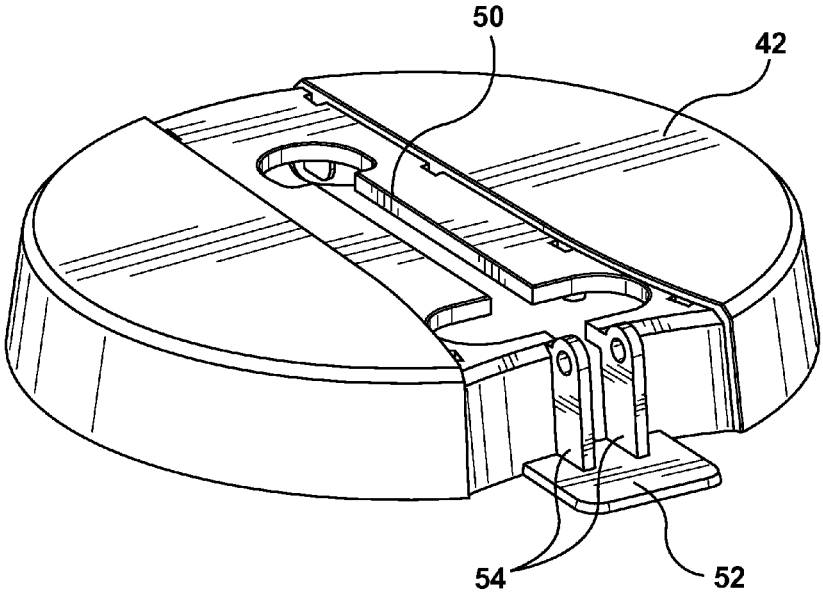
FIG. 4 is an upper perspective view of a lid case of the dispensing apparatus of FIG. 1.

Referring now to FIG. 3, the lid liner 40 includes a central slot 46, and an axle 48 arranged at one end of the central slot 46. Referring to FIG. 4, the lid case 42 includes a central slot 50, a plate 52 arranged along a perimeter of the lid case 42, and a pair of mounting tabs 54 extending upwardly from the plate 52.

Figure 5:
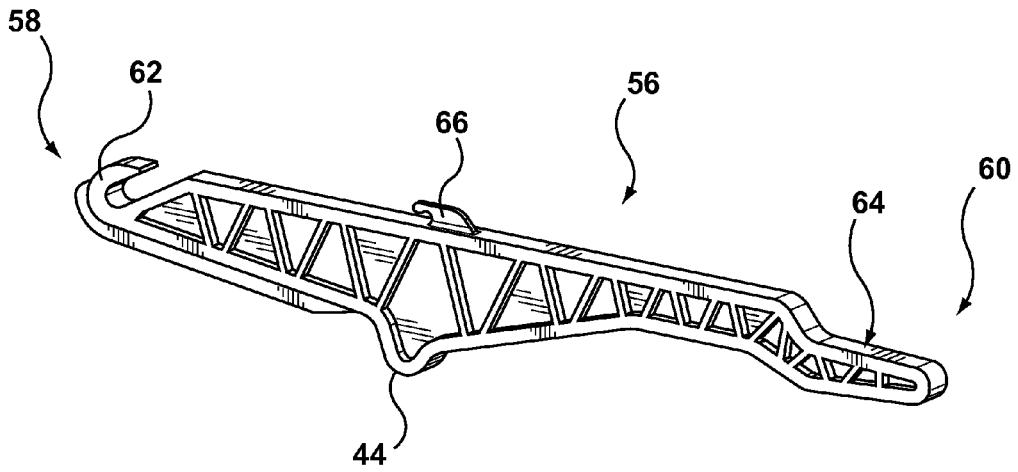
FIG. 5 is an upper perspective view of a lever of the dispensing apparatus of FIG. 1.

Referring now to FIG. 5, a lever 56 is generally elongate and extends between a retained end 58 and a pivoting end 60. At the retained end 58, a hook 62 defines a channel. At the pivoting end 60, a follower surface 64 is defined along an upper surface thereof. A spring catch 66 is arranged along the upper surface of the lever 56, approximately midway between the ends 58, 60. The plunger 44 is arranged extending downwardly from a bottom surface of the lever 56, approximately midway between the ends 58, 60.

In the example illustrated, the plunger 44 and the lever 56 are integral. In other examples, the plunger and the lever may be formed of separate components, which are either in direct contact with one another, or are connected indirectly through one or more intervening mechanical elements.

Figure 7:
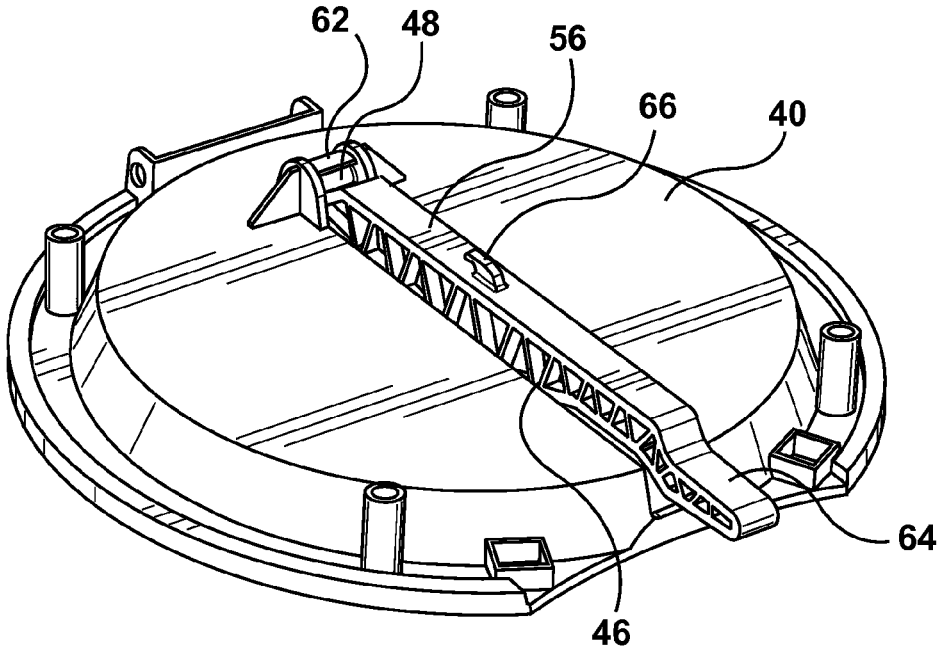
FIG. 7 is an upper perspective view of the lever pivotally mounted to the lid liner.
Figure 8:
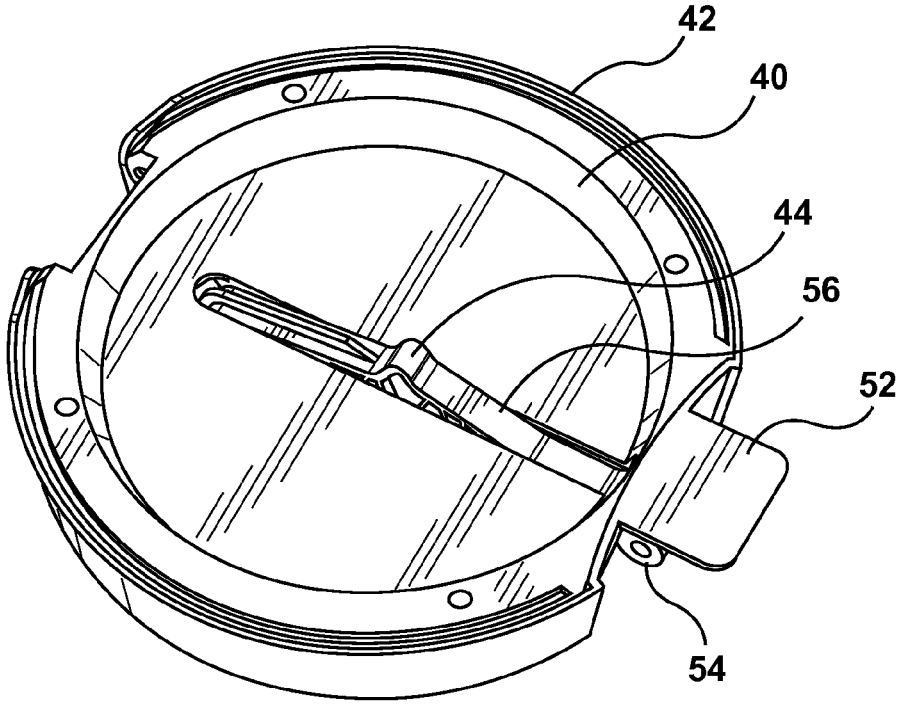
FIG. 8 is a lower perspective view of the lid liner, the lid case, and the lever, assembled together.

Skipping ahead now to FIGS. 7 and 8, the hook 62 engages the axle 48, so that the lever 56 may pivot about the axle 48. The lever 56 extends generally through the central slot 46 of the lid liner 40, with the plunger 44 protruding below the lid liner 40.

Figure 6:
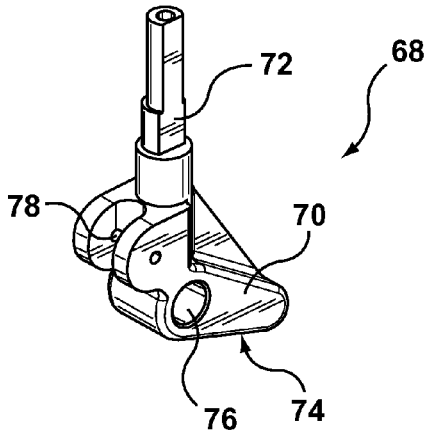
FIG. 6 is an upper perspective view of a linkage member of the dispensing apparatus of FIG. 1.

Referring back to FIG. 6, a linkage member 68 includes a base 70, and a shaft 72 extending upwardly from the base 70. A bottom of the base 70 defines a cam surface 74, which is arranged at an angle relative to an axis defined by the shaft 72, resulting in a generally L-shaped configuration. The linkage member 68 further includes a thru-hole 76 that extends through the base 70 between opposing sides, and a spring pin 78.

Figure 9:
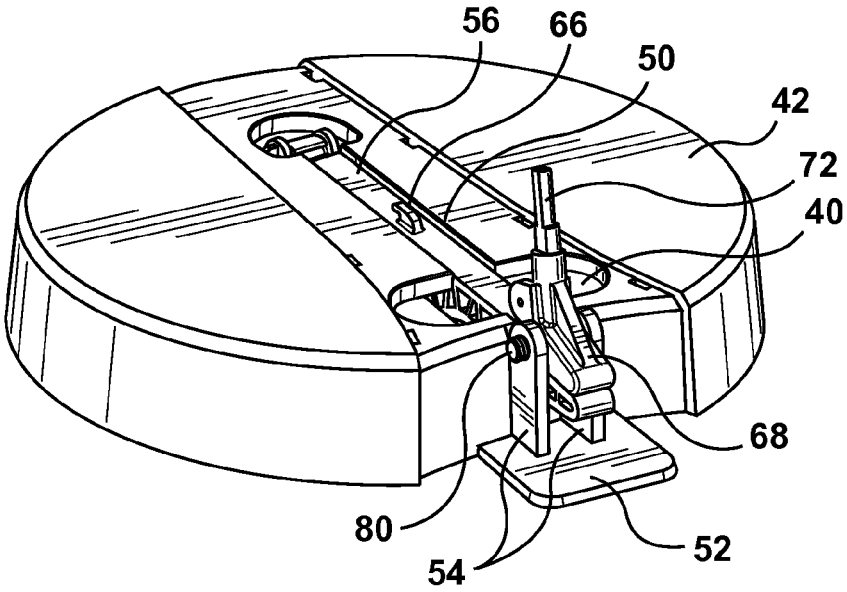
FIG. 9 is an upper perspective view of the lid liner, the lid case, the lever, and the linkage member, assembled together.

FIG. 9 shows the linkage member 68 assembled with the lid liner 40, the lid case 42, and the lever 56. In the example illustrated, an axle 80 extends through the thru-hole 76 (obscured from view), to pivotally mount the linkage member 68 to the mounting tabs 54. However, in examples where the pour actuator takes the form of a push button, the linkage member 68 may be omitted, and the push button may be arranged to translate downward motion to the lever 56 through the lid case 42, via direct contact or indirectly through one or more intervening mechanical elements.

Figure 10:
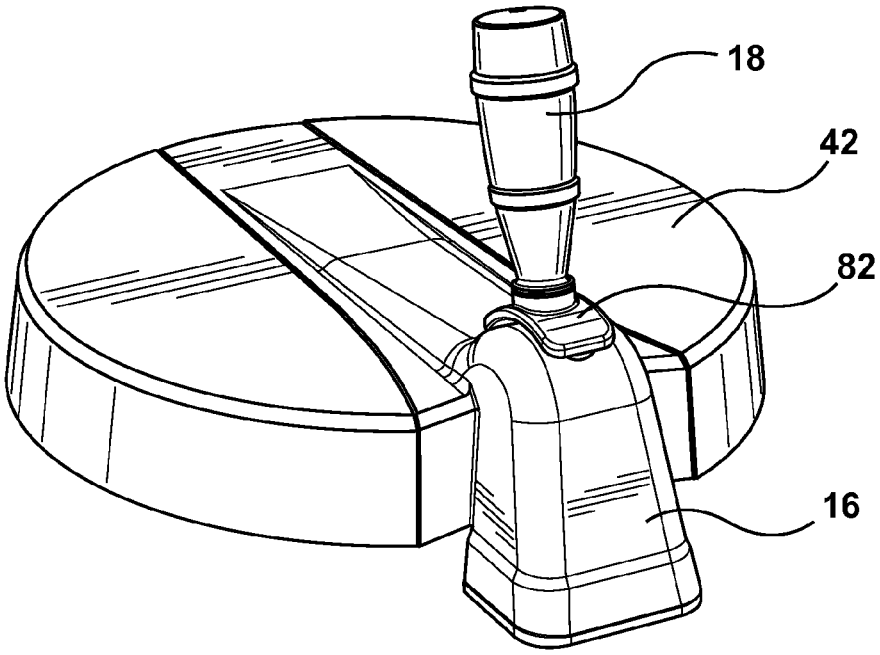
FIG. 10 is an upper perspective view of the lid case, a top case, a shaft sleeve, and a pour actuator of the dispensing apparatus of FIG. 1.

FIG. 10 shows a shaft sleeve 82 and the pour actuator 18 installed onto the shaft 72 of the linkage member 68 (both obscured from view), and the top cap 16 installed onto the lid case 42. The top cap 16 generally conceals the lever 56 and the linkage member 68, and may be fastened to the lid case 42, e.g., with fasteners, adhesive, and/or a snap fit arrangement. The shaft sleeve 82 generally conceals a slot (also obscured from view) provided in the top cap 16, which allows room for the shaft 72 to move with the pour actuator 18 between released and actuated positions.

Figure 11:
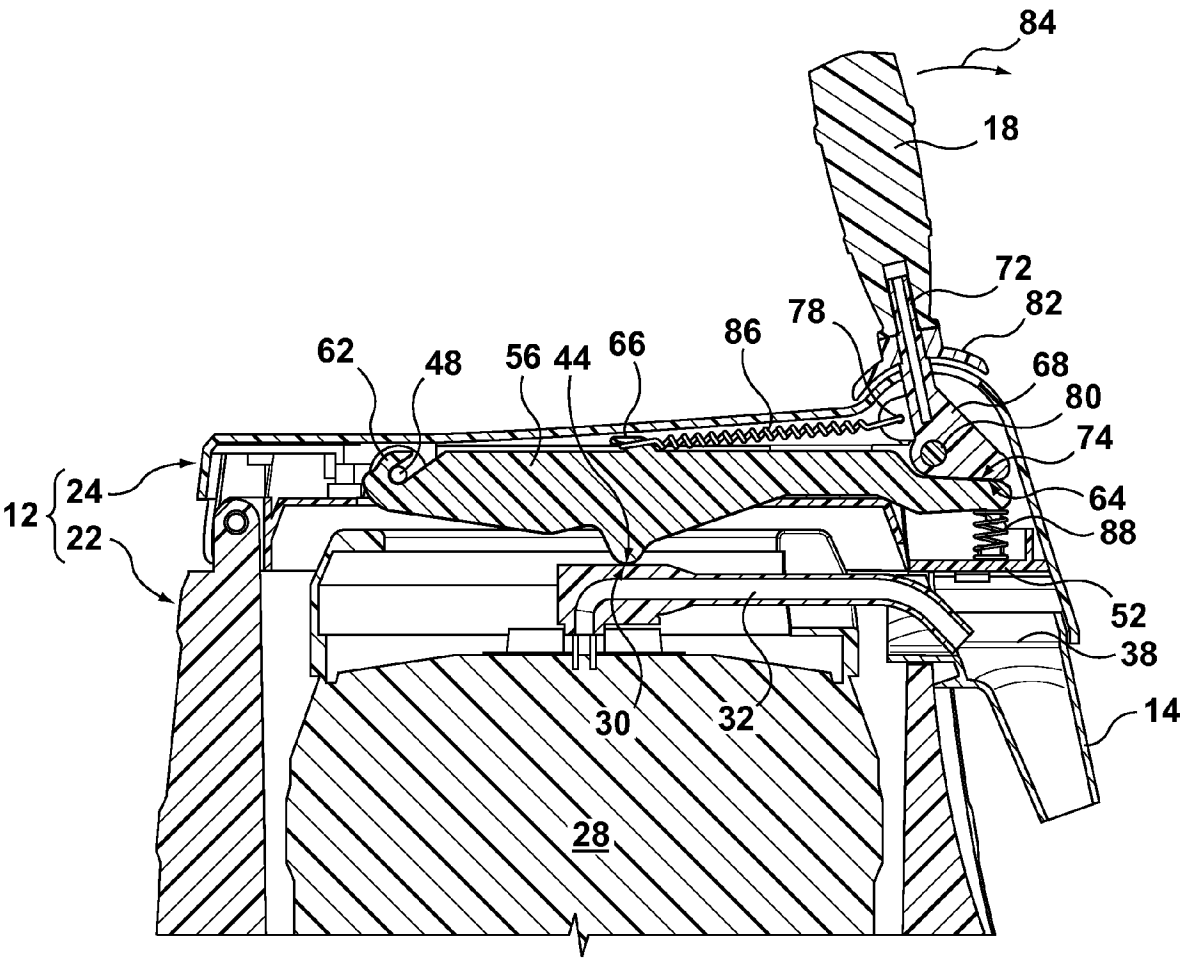
FIG. 11 is a detailed sectional view of the dispensing apparatus of FIG. 1, in which the pour actuator is in a released position.
Figure 12:
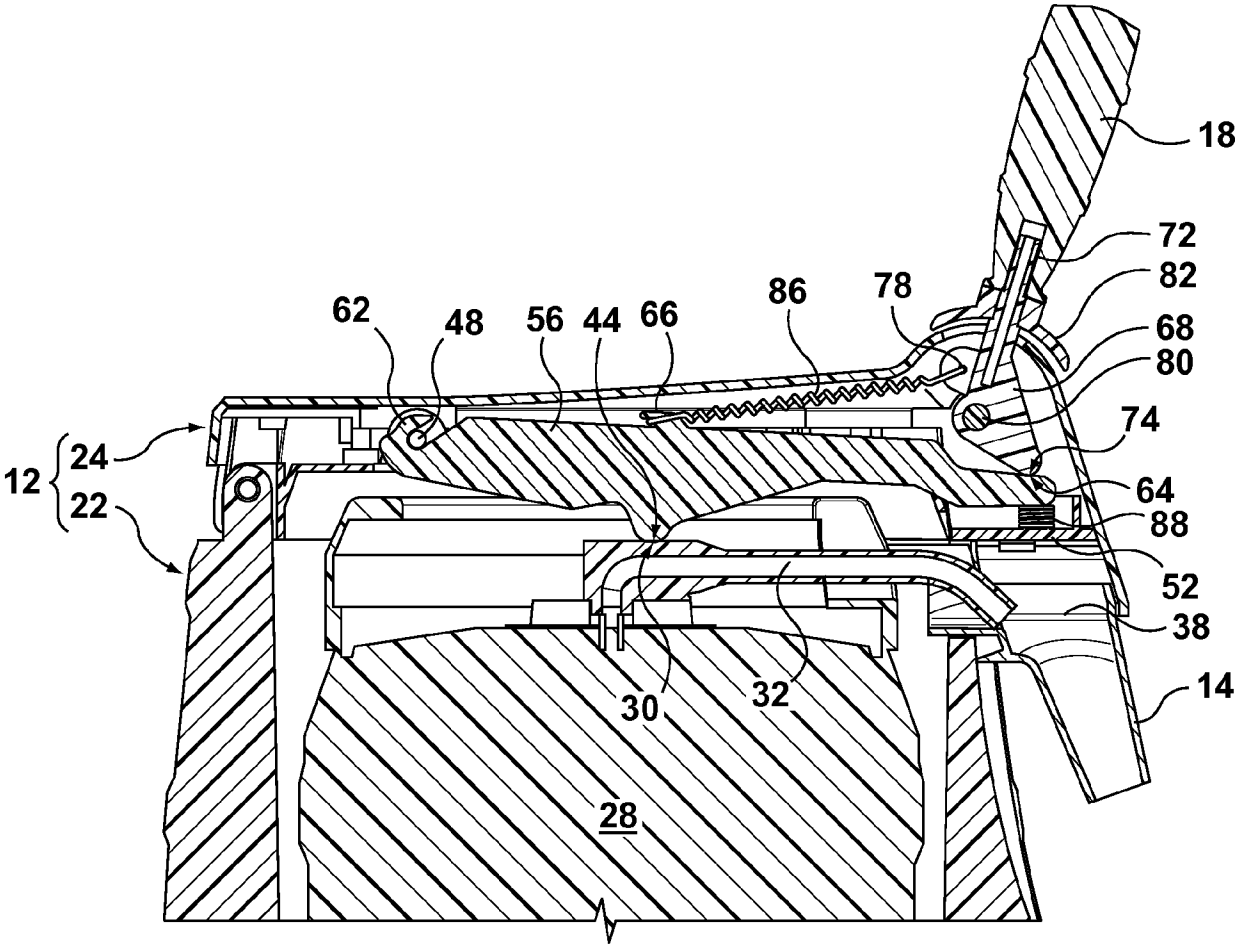
FIG. 12 is a detailed sectional view of the dispensing apparatus of FIG. 1, in which the pour actuator is in an actuated position.

Referring now to FIGS. 11 and 12, the pour actuator 18 is movable in a direction 84 between a released position (FIG. 11) and an actuated position (FIG. 12). In the actuated position, the linkage member 68 has pivoted about the axle 80, so that the cam surface 74 bears downwardly against the follower surface 64 of the lever 56. This causes the lever 56 and the plunger 44 to move downwardly in unison, with the plunger 44 depressing the push valve 30 of the pressurized container 28 to permit contents of the pressurized container 28 to be dispensed through the flow channel 32, into the reservoir 38 and out of the spout 14.

A first biasing member in the form of a first spring 86 is shown connected between the spring catch 66 of the lever 56 and the spring pin 78 of the linkage member 68. The first spring 86 may serve to bias the pour actuator 18 to the released position, and may also bias the lever 56 upwardly. Furthermore, a second biasing member in the form of a second spring 88 is shown positioned between the plate 52 and the lever 56. The second spring 88 may also bias the lever 56 upwardly. The springs 86, 88 tend to return the pour actuator 18 to the released position, and disengage the plunger 44 from the push valve 30, after a pouring operation.

The pour actuator 18 in the example illustrated is a handle that moves forwards and backwards, from the user's perspective, during a pouring operation. The direction 84 is generally perpendicular to the downward movement of the plunger 44. As the pour actuator 18 is pulled in the direction 84 to move to the actuated position, this force encourages the lid assembly 24 to remain closed, which may generally counterbalance the upward force of the plunger 44 being exerted on the lid assembly 24. This offsets or at least reduces the amount of force that is necessary (provided by the suitable mechanical or magnetic mechanism) to maintain the lid assembly 24 closed while the plunger 44 depresses the push valve 30.

Figure 13:
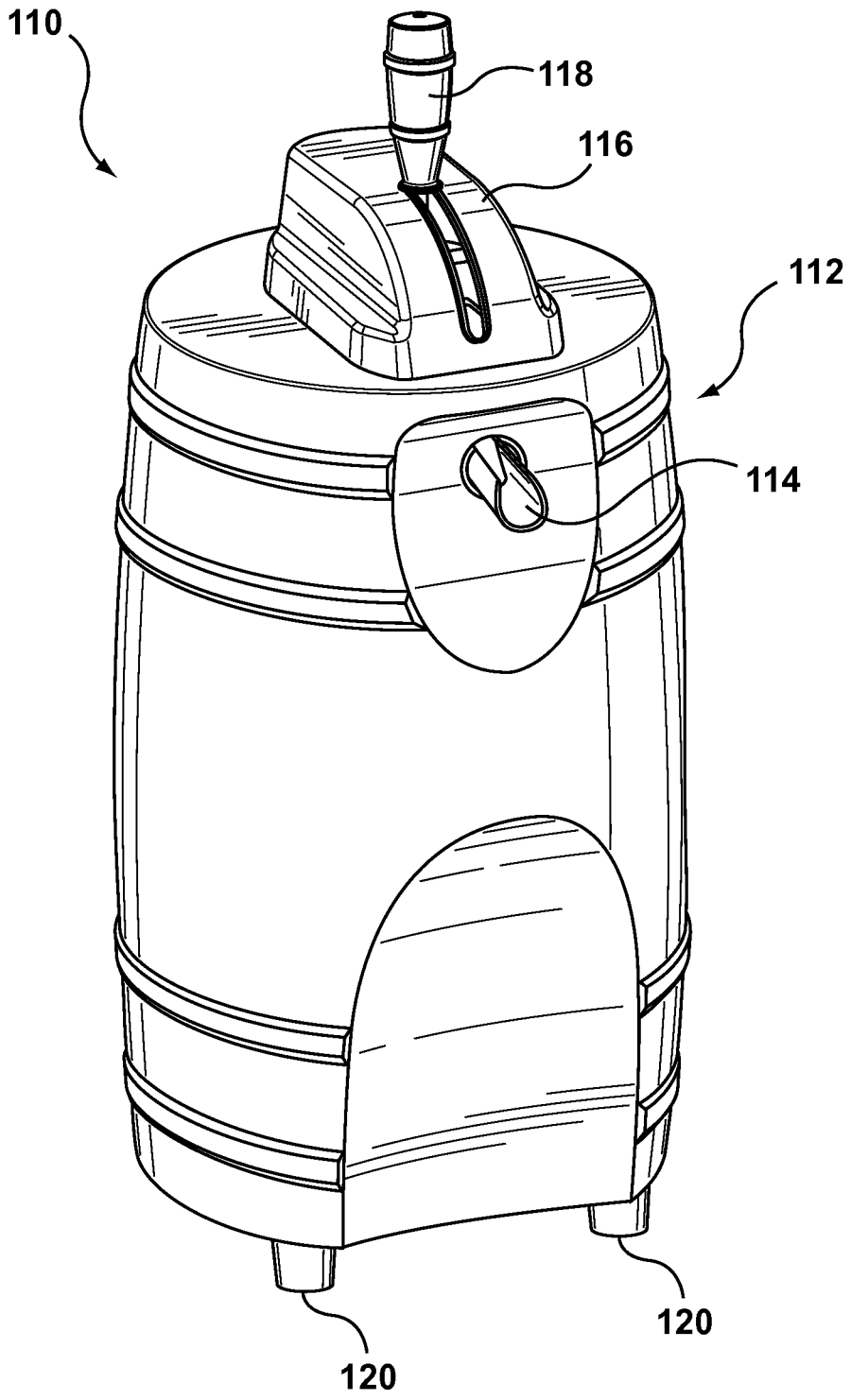
FIG. 13 is a perspective view of a dispensing apparatus according to another example.

Referring to FIG. 13, another example of a dispensing apparatus is shown generally at 110. The dispensing apparatus 110 includes an enclosure 112, a spout 114, a top cap 116 and a pour actuator 118. Feet 120 are provided along a bottom surface of the enclosure 112 to raise the dispensing apparatus 110 off of a ground surface.

Figure 14:
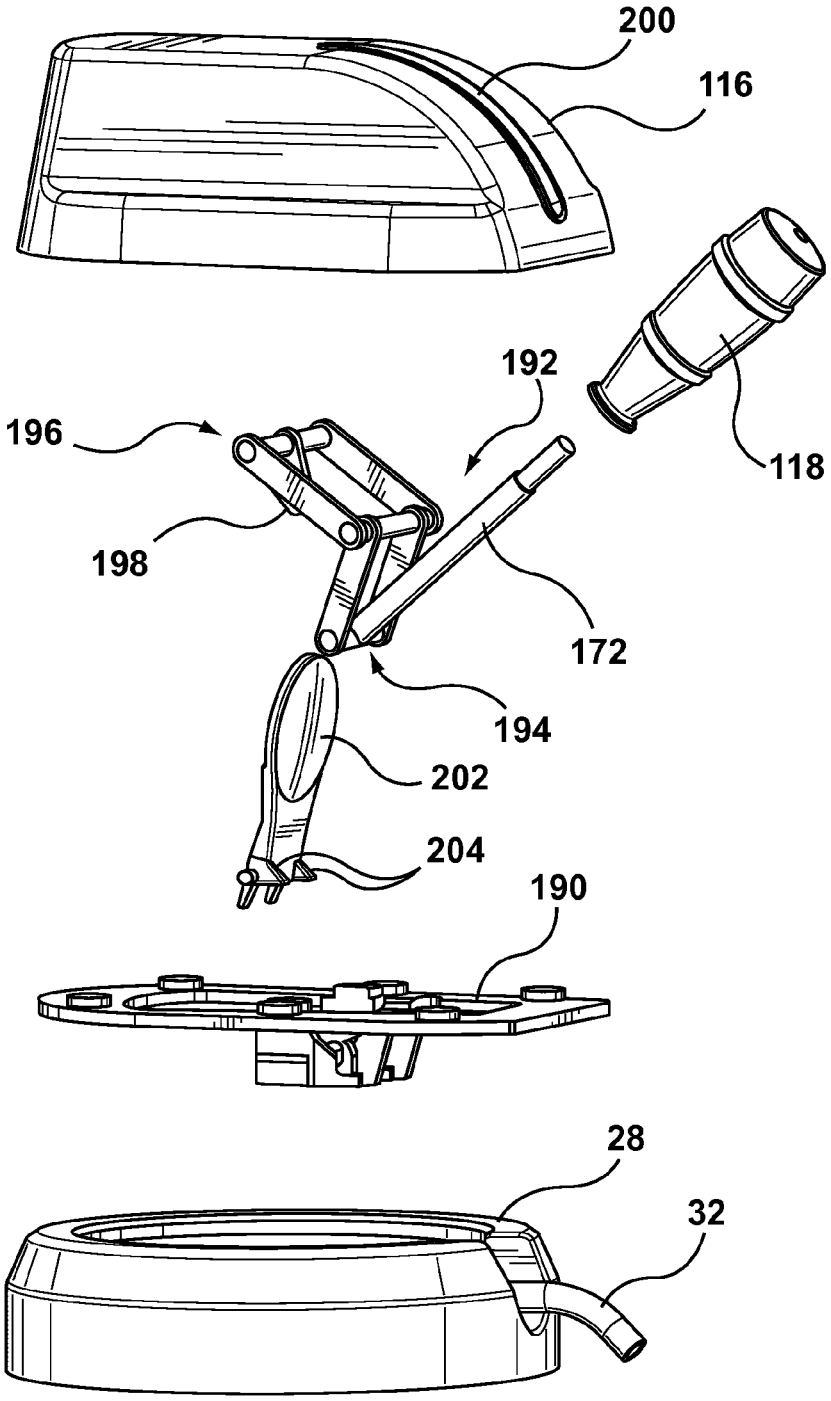
FIG. 14 is an exploded view of parts of the dispensing apparatus of FIG. 13.

Referring to FIG. 14, the dispensing apparatus 110 includes a bottom cap 190, which is positioned above the top wall of the pressurized container 28. A bracket member 192 includes a shaft 172 fixed to a first end 194, and a second end 196 spaced apart from the first end 194. A stopper 198 is mounted to the second end 196. The first end 194 of the bracket member 192 is seated in the bottom cap 190, and is permitted to pivot relative thereto. The shaft 172 extends out of a slot 200 of the top cap 116, and is joined to the pour actuator 118. A tab 202, which may be sold with the pressurized container 28 or may be included as a part of the dispensing apparatus 110, pivots relative to the pressurized container 28 so that prongs 204 depress the push valve (not shown) of the pressurized container 28.

In use, the pour actuator 118 is moved forwards and backwards within the slot 200, between released and actuated positions, similar to the description above with respect to the dispensing apparatus 10. When being moved to the actuated position, the bracket member 192 pivots about the bottom cap 190, and the stopper 198 urges the tab 202 forwardly. This causes the prongs 204 to move downwardly and depress the push valve of the pressurized container 28 to permit contents of the pressurized container 28 to be dispensed through the flow channel 32, and out of the spout 114.

Although the present disclosure describes apparatuses and methods particularly in the context of beer mini kegs, it should be appreciated that the concepts herein may also be used with other pressurized containers. For example, paint, insecticide and other fluid dispensing applications may also be implemented.

It will be appreciated by those skilled in the art that many variations are possible within the scope of the claimed subject matter. The examples that have been described above are intended to be illustrative and not defining or limiting.

We claim:

1. A dispensing apparatus for use with a pressurized container having a push valve, the dispensing apparatus comprising:

an enclosure adapted to enclose at least a portion of the pressurized container;

a pour actuator coupled to the enclosure, and movable between a released position and an actuated position;

a plunger controlled by the pour actuator, and arranged so that, when the pour actuator is moved to the actuated position, the plunger depresses the push valve of the pressurized container to permit contents of the pressurized container to be dispensed out of the dispensing apparatus; and at least one mechanical device adapted to move the plunger downwardly to depress the push valve of the pressurized container, wherein the at least one mechanical device comprises a lever connected between the pour actuator and the plunger, wherein the at least one mechanical device comprises a linkage member connected between the pour actuator and the lever, and wherein the linkage member is adapted to move a pivoting end of the lever downwardly when the pour actuator is moved to the actuated position.

2. The dispensing apparatus of claim 1, wherein a cam surface of the linkage member bears against a follower surface of the lever to move the pivoting end of the lever downwardly.

3. The dispensing apparatus of claim 2, wherein the linkage member pivots to move the pivoting end of the lever downwardly.

4. The dispensing apparatus of claim 1, further comprising a first biasing member connected between the lever and the linkage member, and biasing the pour actuator to the released position.

5. The dispensing apparatus of claim 4, wherein the first biasing member biases the lever upwardly.

6. The dispensing apparatus of claim 5, further comprising a second biasing member positioned underneath the pivoting end of the lever, the second biasing member biasing the lever upwardly.

7. The dispensing apparatus of claim 1, wherein the pour actuator comprises at least one of a handle and push button.

8. The dispensing apparatus of claim 1, further comprising a spout coupled to the enclosure, and connectable to a flow channel of the pressurized container.

9. The dispensing apparatus of claim 1, wherein the enclosure comprises a body and a lid assembly.

10. The dispensing apparatus of claim 9, wherein the enclosure is mounted to the pressurized cylinder by opening the lid assembly, and inserting the pressurized container into an inner cavity of the body.

11. The dispensing apparatus of claim 9, wherein the body comprises a cooling mechanism for cooling the pressurized container.

12. In combination, the dispensing apparatus of claim 6 mounted to a pressurized container.

13. The dispensing apparatus of claim 1, wherein the lever and the plunger are integral.

14. The dispensing apparatus of claim 10, wherein the pour actuator is movable in a forward direction between the released position and the actuated position, and force applied to the pour actuator in the forward direction at least reduces an amount of force that is necessary to maintain the lid assembly in a closed position while the plunger depresses the push valve downwardly.

15. A dispensing apparatus for use with a pressurized container having a push valve, the dispensing apparatus comprising:

an enclosure adapted to enclose at least a portion of the pressurized container;

a pour actuator arranged on an outside of the enclosure, and movable between a released position and an actuated position;

a plunger arranged on an inside of the enclosure, and positioned for alignment with the push valve of the pressurized container;

a lever arranged between the pour actuator and the plunger, the lever comprising a retained end and a pivoting end; and a linkage member arranged between the pour actuator and the lever, wherein, when the pour actuator is moved to the actuated position, a cam surface of the linkage member bears against a follower surface of the lever to move the pivoting end of the lever downwardly, and wherein downward movement of the lever causes the plunger to depress the push valve of the pressurized container to permit contents of the pressurized container to be dispensed out of the dispensing apparatus.

16. The dispensing apparatus of claim 15, wherein the pour actuator comprises at least one of a handle and push button, and further comprising a spout coupled to the enclosure, and connectable to a flow channel of the pressurized container.

17. The dispensing apparatus of claim 15, further comprising a first biasing member connected between the lever and the linkage member, and biasing the pour actuator to the released position, the first biasing member biasing the lever upwardly.

18. The dispensing apparatus of claim 17, further comprising a second biasing member positioned underneath the pivoting end of the lever, the second biasing member biasing the lever upwardly.

19. The dispensing apparatus of claim 15, wherein the pour actuator is movable in a forward direction between the released position and the actuated position, and force applied to the pour actuator in the forward direction at least reduces an amount of force that is necessary to maintain a lid assembly of the enclosure in a closed position while the plunger depresses the push valve downwardly.

20. A dispensing apparatus for use with a pressurized container having a push valve, the dispensing apparatus comprising:

a lever comprising a retained end, a pivoting end spaced apart from the retained end, and a plunger extending outwardly from a surface of the lever generally between the retained and pivoting ends, the plunger positioned for depressing the push valve of the pressurized container;

a pour actuator movable between a released position and an actuated position; and a linkage member connected between the lever and the pour actuator, wherein, when the pour actuator is moved from the released position to the actuated position, the linkage member bears against the lever for moving the pivoting end of the lever towards the pressurized container to cause the plunger to depress the push valve of the pressurized container, and wherein the pour actuator is biased to return to the released position from the actuated position, for moving the pivoting end of the lever generally away from the pressurized container to cause the plunger to disengage the push valve.

* * * * *